United States Patent [19]

Ebashi

[11] Patent Number: 4,949,700

[45] Date of Patent: Aug. 21, 1990

[54] INGOT SUPPORT DEVICE IN SLICING APPARATUS

[75] Inventor: Masao Ebashi, Mitaka, Japan

[73] Assignee: Tokyou Seimitsu Co., Ltd., Japan

[21] Appl. No.: 281,534

[22] Filed: Dec. 8, 1988

[30] Foreign Application Priority Data

Dec. 17, 1987 [JP] Japan ..... 62-191549
Dec. 17, 1987 [JP] Japan ..... 62-191550
Dec. 17, 1987 [JP] Japan ..... 62-191551

[51] Int. Cl.[5] ..... B28D 1/04

[52] U.S. Cl. ..... 125/13.01; 125/35; 51/73 R; 83/409

[58] Field of Search ..... 83/36, 42, 409, 409.2, 83/703, 707, 718, 719, 720, 730; 125/35, 13 R; 51/73 R

[56] References Cited

U.S. PATENT DOCUMENTS 3,039,235 6/1962 Heinrich ..... 51/73 R
3,662,733 5/1972 Okamoto ..... 51/73 R
3,802,412 4/1974 Lane ..... 51/73 R
3,855,738 12/1974 Guggehheim, Sr. et al. .... 125/13 R
4,228,782 10/1980 Demers et al. ..... 51/73 R

FOREIGN PATENT DOCUMENTS 50-1310 1/1975 Japan .
54-1961 1/1979 Japan .
441152 5/1975 U.S.S.R. ..... 51/73 R
657979 4/1979 U.S.S.R. ..... 51/73 R
1319768 6/1973 United Kingdom ..... 51/73 R
1394707 5/1975 United Kingdom ..... 51/73 R

*Primary Examiner*—Hien H. Phan
*Assistant Examiner*—Scott A. Smith

[57] ABSTRACT

A slicing apparatus is disclosed which slices a cylindrical ingot into disc-shaped wafers by a rotating blade. The slicing apparatus includes an ingot support device which is used to contact support the ingot at a position opposed to the position of the ingot to be sliced by the blade. Therefore, a rection force which is produced in the ingot slicing can be supported by the ingot support device, thereby eliminating any ill effects on the hold surface of the ingot.

6 Claims, 2 Drawing Sheets

INGOT SUPPORT DEVICE IN SLICING APPARATUS

BACKGROUND OF THE INVENTION

1. Field of the Invention

The present invention relates to an ingot support device a slicing apparatus which is used to slice out a thin wafer from the end face of a cylindrical ingot in a semiconductor wafer manufacturing process.

2. Description of the Related Art

In a slicing apparatus, the upper end of a cylindrical ingot is held by a hold mechanism provided in the slicing apparatus by use of an adhesive or the like and, while the lower end portion of the ingot is being pressed against the internal peripheral edge of a blade revolving at high speeds, the ingot lower end portion is sliced out into a thin disc-shaped wafer by the internal peripheral edge blade. In the above-mentioned slicing apparatus, the ingot that is held in a cantilevered manner by the hold mechanism suffers a slicing resistance, that is, the upper end portion of the ingot that is held by the hold mechanism is given a flexing pressure, so that the ingot is caused to move back in a direction away from the above-mentioned blade edge. The flexing pressure is small at the beginning of slicing, gets gradually larger as the slicing advances, and gets small again in the neighborhood of the end of the slicing. Therefore, there is a problem that the sliced surface of the wafer may not be a flat surface but be a curved one. In order to solve this problem, there has been proposed a technique to hold the lower end portion of the ingot, namely, the portion thereof disposed close to the blade edge in a fixed manner. For example, this technique is disclosed in Japanese Utility Model Publication No. 54-1961, No. 50-1310 and the like. In the former model, in the inner tip end of a cylindrical holder there is provided a structure which is capable of vacuum adsorption of an ingot so as to fix and hold the end portion of the ingot. In the latter, there is provided a structure to further press the ingot end portion, which is located along a holding table, toward the holding table so as to fix and hold the ingot end portion. In either of these structures, however, since the ingot is fixed and held by applying partial loads thereto, the hold surface of the ingot upper end is also affected by the loads, as in the above-mentioned slicing resistance, so that a pressure is given to the ingot to peel off the adhesive surface thereof. Therefore, in order to avoid the above-mentioned drawbacks, the ingot must be set with high accuracy, resulting in the more troublesome and complicated setting operation.

SUMMARY OF THE INVENTION

The present invention aims at eliminating the drawbacks found in the above-mentioned prior art support devices.

Accordingly, it is an object of the invention to provide an ingot support device which has no ill effects on the adhesive surface of an ingot.

In order to attain the above object, according to the invention, there is provided a slicing apparatus which comprises: a rotary blade for slicing a cylindrical ingot into a disc-shaped wafer; a first moving mechanism movable in an ingot slicing direction orthogonal to the axis of the ingot; a second moving mechanism for holding one end of the ingot, the second moving mechanism being supported by the first moving mechanism such that it is free to move in the axial direction of the ingot and an ingot support device provided in the first moving mechanism for contact supporting the ingot at a position substantially opposite to the position of the ingot to be sliced by the blade.

In the present invention, when slicing the ingot, the ingot support device is used to support the ingot at a position opposite to the position of the ingot to be sliced by the blade against a reaction force which is produced in slicing, thereby avoiding ill effects on the adhesive layer of the ingot while the ingot is being sliced.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the preferred embodiments of an ingot support device for use in a slicing apparatus according to the present invention with reference to the accompanying drawings.

Figure 1:
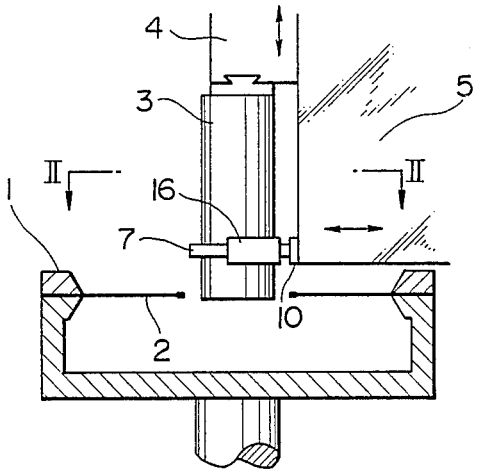
FIG. 1 is a front view of the general structure of an ingot support device for use in a slicing apparatus according to the invention.

Referring first to FIG. 1, there is shown an outline of a slicing apparatus in which there is provided a bowl-shaped body of rotation 1 having an open upper surface, an internal peripheral edge blade 2 is arranged on the upper edge of the rotation body 1, and an ingot 3 is erected in the central bore thereof. In the slicing apparatus, in the above-mentioned condition, the blade 2 is rotated at a high speed and the ingot 3 is pushed in the right direction in FIG. 1 against the blade 2, so that the lower end face of the ingot 3 is sliced into a thin wafer. In this case, the ingot 3 is held at the upper end thereof and the ingot is then moved up and down as well as right and left to be cut. Here, the upward and downward movements of the ingot are a pitch feed to slice out the wafers one by one and for this pitch feed there is provided a moving mechanism 4 which is conventionally well known and has a screw driven mechanism. Also, the right and left movements of the ingot is a feed to press the ingot against the blade edge or retreat it from the blade edge and, for this, purpose, there is provided a right and left moving mechanism 5 which includes the above-mentioned upward and downward moving mechanism 4. That is, the upward and downward moving mechanism 4 is supported by the right and left moving mechanism 5 in such a manner that it is free to move upwardly and downwardly, and the right and left moving mechanism 5 is supported by a main body (not shown) of the slicing apparatus in such a manner that it is free to move right and left.

Figure 2:
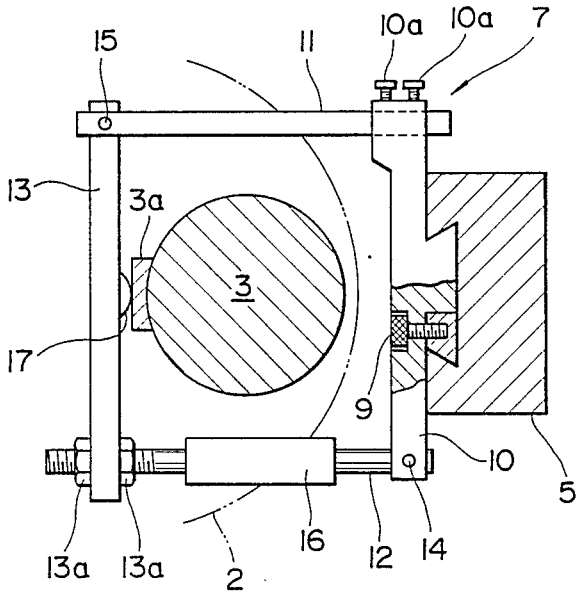
FIG. 2 is a section view taken along the line II—II in FIG. 1, illustrating a first embodiment of an ingot support device according to the invention.

In FIG. 2, a bar base 10 is mounted to the right and left moving mechanism 5 by a screw 9. The bar base 10 can be mounted at an arbitrary height position with respect to the right and left moving mechanism 5 by loosening the screw 9. First and second bars 11 and 12 are respectively extending from the bar base 10 and the respective leading ends thereof are connected by a third bar 13. The bar base 10 and these three bars cooperate to form a quadrilateral frame in such a manner that the ingot 3 can be surrounded by the quadrilateral frame. In this structure, the bar base 10 and second bar 12 can be rotated mutually by means of a pin 14 and there is provided a pin 15 between the first and third bars 11 and 13, so that they are rotatable to each other. Also, the first bar 11 can be freely slided relative to the bar base 10 by loosening screws 10*a*, 10*a* and the second bar 12 can be freely slided relative to the third bar 13 by loosening nuts 13*a*, 13*a*. Due to such construction, the size of the quadrilateral frame can be adjusted according to the diameter of the ingot 3.

The second bar 12 is divided into two sections and a lock cylinder 16 is interposed between the two sections. Also, the third bar 13 is adapted to touch and support the ingot 3 from the opposite side of the cutting side thereof to prevent the ingot from escaping due to the cutting or slicing resistance. On the inside wall of the third bar 13 there is provided a contact portion 17 for contact with a slice base 3*a* which is attached to the ingot 3.

For the above-mentioned lock cylinder 16, there have been used various types of lock cylinders and one of them has such a mechanism that a piston disposed within the cylinder is moved by controlling pressurized air and is locked (clamped) at a desired position with respect to the cylinder.

Referring to the operation of the lock cylinder, if the pressurized air is supplied through an air supply hole (not shown), then the piston in the cylinder is moved to push out, for example, a piston rod which forms one section of the second bar 12. As a result of this, in the above-mentioned quadrilateral frame that is composed of four bars, the second bar 12 is extended to rotate the third bar 13 clockwise about the pin 15, so that the contact portion 17 is caused to widen a space from the ingot (slice base 3*a*). Next, if the air supply is stopped and the cylinder 16 is operated in reverse, then the piston is moved in the return direction thereof to bring the contact portion 17 into contact with the ingot 3 (slice base 3*a*). On detection of this contact, if the internal lock mechanism is operated, then the second bar 12 is locked and the contact portion 17 maintains its contact with the ingot 3. Then, in this condition, if the ingot 3 is moved in the direction of the blade 2, then the ingot 3 is fixed at the upper and lower ends thereof so that the ingot 3 can be sliced properly.

On completion of slicing of a first wafer, the locking state of the lock cylinder 16 is removed, the contact portion 17 is parted away from the ingot 3 by a similar operation to the above-mentioned one, and the upward/downward moving mechanism 4 is driven to move the ingot 3 down by a pitch for the next slicing. The operation of the lock cylinder 16 may be automatically controlled by a signal which indicates the completion of slicing of the wafer.

As described above, according to the invention, when the slicing of a piece of wafer is completed, then the third bar 13, which is in contact with the slice base 3*a* of the ingot 3, is moved away from the slice base 3*a* to thereby render the ingot 3 free, so that the ingot 3 is then moved down by one pitch of the wafer. After then, the contact portion 17 of the third bar 13 is again brought into contact with the ingot 3 and, in this state, the ingot 3 is locked by the lock cylinder 16. Thanks to this, the end portion of the ingot 3 can be contacted and supported from the opposite side of the slicing thereof without applying excessive loads and thus the wafer can be sliced out from the ingot end portion regardless of the magnitude of the slicing resistance. Also, according to the present invention, the ingot lower end portion can be supported without paying special attention to the holding state of the ingot and, therefore, a highly efficient device can be provided.

Figure 3:
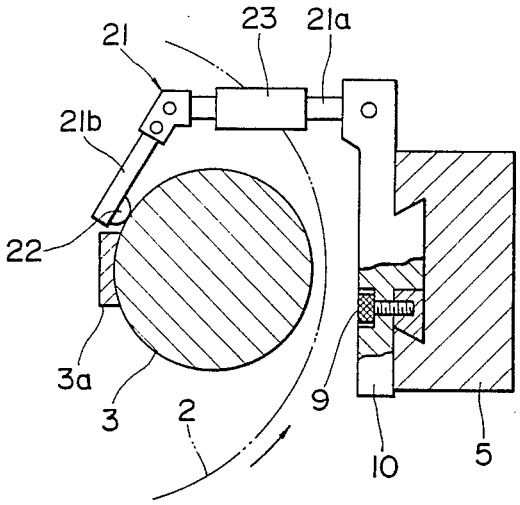
FIG. 3 is a section view of a second embodiment of an ingot support device according to the invention; and, FIG. 4 is a section view of a third embodiment of an ingot support device according to the invention.

Referring now to FIG. 3, there is shown a second embodiment of an ingot support device according to the invention.

In FIG. 3, there is arranged an ingot support arm 21 which extends from a base 10 in the direction of an ingot 3. The ingot support arm 21 is bent at the middle portion thereof and is divided into two sections; one is a base-side arm section 21*a* and the other is a leading-end-side arm section 21*b*. In the base-side arm section 21*a* there is provided a lock cylinder 23 which is similar to the cylinder in the first embodiment and in the arm section 21*b* there is provided an ingot contact portion 22 which allows the arm to come in contact with the ingot 3 from the opposite side of slicing of the ingot 3. The support arm 21 is used to prevent the escape of the ingot 3 and thus the contact position of the contact portion 22 with the ingot may be a slice base 3*a* attached to the ingot. However, from the viewpoint of effects, it is preferred that the contact portion 22 is able to come into contact with the ingot in the opposite surface portion of a reaction which is produced due to the slicing resistance of an internal peripheral edge blade 2, that is, a vector direction position which is obtained from the push direction of the ingot 3 and the rotational direction of slicing of the internal peripheral edge blade, for example, as shown in FIG. 3, a position which is shifted left slightly from the slice base 3*a*.

Since in the base-side arm 21*a* there is provided the lock cylinder 23 as discussed before, a portion of the base-side arm 21*a* is formed by a rod which is connected to a piston (not shown) within the lock cylinder 23.

Referring to the operation of the cylinder 23, if a pressurized air is supplied through an air supply hole (not shown), then the piston within the lock cylinder 23 is moved to push out the piston rod (the base-side arm section 21*a*). As a result of this, the support arm 21 is caused to extend so that the contact portion 22 is moved away from the ingot 3. Next, if the air supply is stopped and the cylinder is operated reversely, then the piston is moved in the return direction thereof to thereby bring the contact portion 22 into contact with the ingot 3 again. After such contact, if a lock mechanism within the lock cylinder is put into operation, then the leading-side arm section 21*b* can be locked in position and the contact portion 22 can be stopped while it is in contact with the ingot 3. Then, in this condition, if the ingot 3 is moved in the direction of the ingot 3, then the ingot 3 can be fixed in the upper and lower end portions thereof for slicing.

Figure 4:
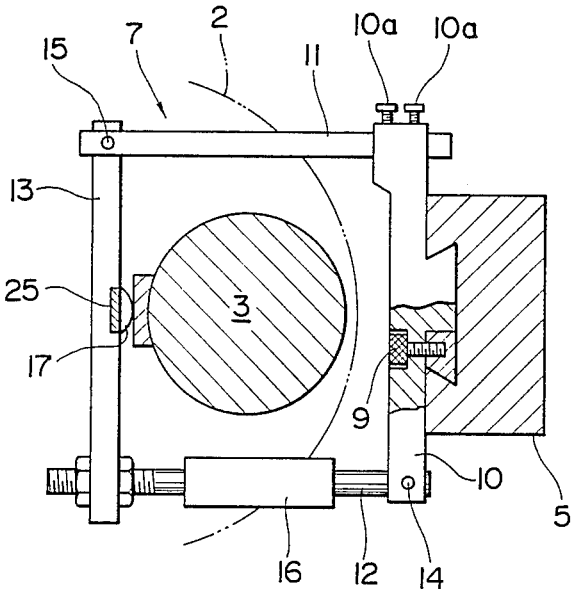

Referring now to FIG. 4, there is shown a third embodiment of an ingot support device according to the invention. In the third embodiment in FIG. 4, the same or similar parts as in the first embodiment of the invention in FIG. 2 are given the same reference characters and the description thereof is omitted here.

In the third embodiment, the magnitude of the slicing resistance of the ingot 3 applied to a moving mechanism 5 is measured and the measured value is used to represent the cutting quality of the blade 2.

A piezo-electric element 25 is interposed between a contact portion 17 and a bar 13 and the variations of the output of piezo-electric element 25 are considered as the variations of the slicing resistance. The values of the slicing resistance output increase gradually from zero at the time of the first contact of the ingot 3 with the blade 2 and then decrease gradually down again to zero. In other words, when the cutting or slicing quality of the blade is lowered, then the slicing resistance acts as a pressure in the opposite direction to the slicing direction so that the peak value of the detection values rises. It should be noted here that as the ingot support device, there are available various types of devices such as the first embodiment, second embodiment and the like, provided that the device can prevent the ingot 3 from escaping or retreating in the opposite direction to the slicing direction. The third embodiment of the invention can be employed in any types of devices and in the third embodiment the piezo-electric element 25 is disposed in the portion of the device where pressure is given.

As has been described above, according to the third embodiment of the invention, since the slicing resistance can be detected directly as a numeral value, the blade can be controlled effectively and a simple and inexpensive device can be provided.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A slicing apparatus comprising:
- a rotary blade for slicing a cylindrical ingot into a disc-shaped wafer;
- a first moving mechanism movable in an ingot slicing direction orthogonal to the axis of said ingot;
- a second moving mechanism for supporting one end of said ingot, said second moving mechanism being supported by said first moving mechanism such that said second moving mechanism is movable in the axial direction of said ingot;
- a base fixedly secured to said first moving mechanism;
- three bars, in cooperation with said base, for forming a quadrilateral surrounding said ingot;
- an ingot contact support device provided in a bar disposed in one of the sides of said quadrilateral opposed to the blade slicing side of said quadrilateral at which the blade initially contacts the ingot; and,
- an expansion/contraction mechanism provided in one of two bars adjoining said bar in which said ingot contact support device is provided, and wherein,
- said expansion/contraction mechanism expands, when said ingot is moved in the axial direction thereof, to cause said ingot contact support device to move away from said ingot, and contracts for slicing of said ingot to cause said ingot contact support device to support said ingot at the opposite side of said ingot to the slicing side thereof.

2. A slicing apparatus as set forth in claim 1, wherein said expansion/contraction mechanism is a cylinder which can be operated by air or oil.

3. A slicing apparatus comprising:
- a rotary blade for slicing a cylindrical ingot into a disc-shaped wafer;
- a first moving mechanism movable in an ingot slicing direction orthogonal to the axis of said ingot;
- a second moving mechanism for holding one end of said ingot, said second moving mechanism being supported by said first moving mechanism such that said second moving mechanism is movable in the axial direction of said ingot;
- a base fixedly secured to said first moving mechanism;
- a first arm erected in said base and extending laterally of said ingot;
- a second arm having one end disposed at a leading end of said first arm and a second end extending in a direction opposite to said ingot slicing direction so as to be able to support said ingot; and
- an expansion/contraction mechanism, provided in said first arm, and wherein,
- said expansion/contraction mechanism, when said ingot is moved in the axial direction thereof, expands to cause said second arm to move away from said ingot, and, when said ingot is sliced, contracts to cause said second arm to support said ingot at the opposite side of said ingot to the slicing side thereof, wherein the slicing side is a side which said blade initially contracts to slice the ingot.

4. A slicing apparatus as set forth in claim 3, wherein said expansion/contraction mechanism is a cylinder which can be operated by air or oil.

5. A slicing apparatus as set forth in claim 1, wherein a piezo-electric element is provided in said ingot contact support device, whereby variations of a slicing resistance can be sensed from the output variations of said piezo-electric element.

6. A slicing apparatus comprising:
- a cylindrical blade for slicing a cylindrical ingot into a disc-shaped wafer;
- a first moving mechanism movable in an ingot slicing direction orthogonal to a longitudinal axis of the ingot;
- a second moving mechanism for supporting one end of said ingot, said second moving mechanism being supported by said first moving mechanism such that said second moving mechanism is movable in the longitudinal direction of the ingot;
- ingot support means for supporting the ingot by a support surface of the support means engaging against a side of the ingot opposite a side which is initially contacted by said blade during cutting;
- wherein said support means further includes expansion/contraction means for moving the support surface away from said ingot during longitudinal movement of said second moving mechanism and for causing said support surface to be engaged with the ingot during cutting.

* * * * *

UNITED STATES PATENT AND TRADEMARK OFFICE

CERTIFICATE OF CORRECTION

PATENT NO. : 4,949,700

DATED : August 21, 1990

INVENTOR(S) : Masao Ebashi

It is certified that error appears in the above-identified patent and that said Letters Patent is hereby corrected as shown below:

On the title page, item [73] Assignee:

The name of the Assignee is changed to: Tokyo Seimitsu Co., Ltd., Japan

Signed and Sealed this

Ninth Day of June, 1992

*Attest:*

*Attesting Officer*

DOUGLAS B. COMER

*Acting Commissioner of Patents and Trademarks*